US005690527A

United States Patent [19]

Rutledge et al.

[11] Patent Number: 5,690,527

[45] Date of Patent: Nov. 25, 1997

[54] COATED FIBROUS SUBSTRATE WITH ENHANCED PRINTABILITY

[75] Inventors: Jerry Dean Rutledge, Macon, Ga.; Ronald Steven Fletcher, Vancouver, Canada; James Lynwood Jonakin, Camden, Ala.

[73] Assignee: MacMillan Bloedel Packaging Inc., Montgomery, Ala.

[21] Appl. No.: 408,249

[22] Filed: Mar. 22, 1995

[51] Int. Cl.[6] ..... B32B 3/26

[52] U.S. Cl. ..... 442/76; 428/318.4; 428/315.7

[58] Field of Search ..... 428/289, 315.7, 428/318.4; 442/76

[56] References Cited

U.S. PATENT DOCUMENTS 4,751,111 6/1988 Lee et al. ..... 427/361

OTHER PUBLICATIONS

Janes, R.L. and McKenzie, J.D., "The Behavior of Bentonites in Pigmented Paper Coatings–Effects on Rheology, Application, Coated Paper Properties and Printability", May 17–19, 1976, TAPPI Coating Conference, Boston, pp. 31–51.

"Clay Chemistry", information provided by Southern Clay Products, Gonzales, Texas.

Booth et al., "Bubble Coating–Sleeping Giant? Could Revolutionize Coating?", Oct. 26, 1970, Paper Trade Journal 154(43).

Lee et al., "Development of Low Glossing Paper Coating Latexes: Theories and Concepts", May 1986 TAPPI Coating Conference, pp. 31–34.

*Primary Examiner*—Christopher Raimund
*Attorney, Agent, or Firm*—C. A. Rowley

[57] ABSTRACT

A new coated fibrous substrate is produced by applying a coating containing swelled super absorbent particles having a minimum dimension of at least 5 microns to obtain the desired porosity and roughness in the finished coating, applying the coating to the substrate at least partially setting the coating thereafter driving at least the majority of the carrier absorbed by the super absorbent particles from the particles to leave macro-voids in the coating and produce a coated surface having a roughness in the macro as opposed to the micro range.

16 Claims, 5 Drawing Sheets

COATED FIBROUS SUBSTRATE WITH ENHANCED PRINTABILITY

1. Field of Invention

The present invention relates to a coated substrate having a surface replicating an uncoated multi-ply board.

2. Background of the Invention

The application of coatings to substrates, such as paper or paper board including linerboard and the like for a variety of different purposes, but primarily to improve the printing characteristics and appearance of the printed sheet is well known. It is common practice to improve the appearance of board such as linerboard by the application of a surface ply generally made from fibers different from (color or the like) the fibers forming the middle or core of the board, i.e. a multiplied board with say, a mottle white face.

The application of the surface ply is to improve the aesthetic effect of the end product, and in many cases, to enhance printing to provide a more acceptable and more visually aesthetic end product carrying the manufacturer's message.

It is also known to incorporate material in coating formulations to form discrete voids in the coating and thereby improve the optical characteristics of the coated product. Such operations include various bubble coating techniques. One of the earlier concepts is described for example in an article "Bubble Coating—Sleeping Giant? Could Revolutionize Coating?" in the Paper Trade Journal 154(43) Oct. 26, 1970 by Booth et at. which describes the application of such coatings to paperboard. The paper "Development of Low Glossing Paper Coating Latexes: Theories and Concepts" by Lee et al. and presented at the TAPPI coating conference in May 1986 (see also U.S. Pat. No. 4,751,111 issued Jun. 14, 1988) describes the use in coating formulations of carboxylated latexes that expand when in the wet coating mix and then collapse when the coating is dried on the substrate to form voids in the coatings.

In all of these applications the size of the voids formed are controlled to enhance the optical properties of the coated substrate and thus the size of the voids and degree of roughness of the coated surface is designed to be in the microscopic range generally less than about 1 micron size generally about 0.2 to 0.7 microns.

It is also known to use super absorbent particles (e.g. particles of cross linked water soluble polyacrylates such as sodium polyacrylates) in coating compositions for the purpose of modifying the rheology of coating as it is applied to the web. In these techniques, very small particles generally in the sub-micron range of super absorbent material are contained within the coating up to a maximum of about 1% of the dried solids of the coating. These small super absorbent particles, when they traverse, for example, a blade of a blade coater or metering bar or the like, or subjected to high shear stresses change the rheology of the coating to facilitate more uniform coating application. In these operations, the main objective is to produce a coated surface that is relatively smooth and has the desired optical properties so that these particle in swelled condition do not have a major dimension exceeding 1 micron.

The cost of producing a multiply board with a surface layer of fibers having different visual appearance from that of the core fibers e.g. a matte white surface layer is dependent on the cost of fiber and has increased significantly. Attempts to find a replacement for the white surface formed by the separate ply applied to the linerboard have not prior to the present invention been successful.

BRIEF DESCRIPTION OF THE PRESENT INVENTION

It is an object of the present invention to provide an improved coating to a substrate to form a coated paper having aesthetics and printability substantially equivalent to for example a mottle white multiply board.

Broadly, the present invention relates to a coated fibrous substrate having a coating on at least one surface thereof, said coating having voids formed therein and a rough surface formed by some of said voids opening through said surface of said coating, a majority said voids having a size of at least 5 microns and less than 100 microns.

Preferably, said surface will have a surface roughness measured by a Parker Print PPS of at least 6.5 for a corresponding Sheffield Smoothness of 290 ml/min and at least 7PPS for a corresponding Sheffield Smoothness of 330 ml/min.

Preferably said coated fibrous substrate will have a Gurley Porosity of less than 3,500 seconds/100 ml preferably less than 3,000 se./100 ml and most preferably less than 2,500 sec/100 ml.

Preferably said coated substrate will have a Print Length of less than 12 cm preferably less than 10.5 cm measured on an MB prim Indicator.

Preferably said coating prior to application will have a Brookfield Viscosity (no.4 spindle 30 rpm) of at least 500 cp.

Preferably, said substrate will be a linerboard and said surface coating produces a coating surface on said, substrate that simulates a multiply mottle white board normally made by application of a suitable fiber layer to a core layer of fibers having different aesthetic value.

The present invention also relates to a method of producing a coated surface on a fibrous substrate comprising forming a coating including a carrier and containing particles having super absorbent characteristics for said carrier, dispersing said super absorbent particles in said coating to produce a coating composition having super absorbent particles that swell when saturated with said carrier into swelled particles the majority of which have a minimum dimension of at least 5 microns, at least partially setting said coating and then driving said carrier from said super absorbent particles to cause said super absorbent particles to collapse and form macro sized voids in said coating an a surface having macro sized roughness elements.

Preferably, said carrier will be water.

Preferably, said swelled particles will have particle size with a minimum dimension in the range of 5 to 100 microns.

Preferably, amount of said super absorbent in said coating will be between 0.5 and 5% based on the dry weights of coating solids in said coating.

Preferably, said coating will be applied in the amount of between 10 and 50 gm/m$^2$ of surface area.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
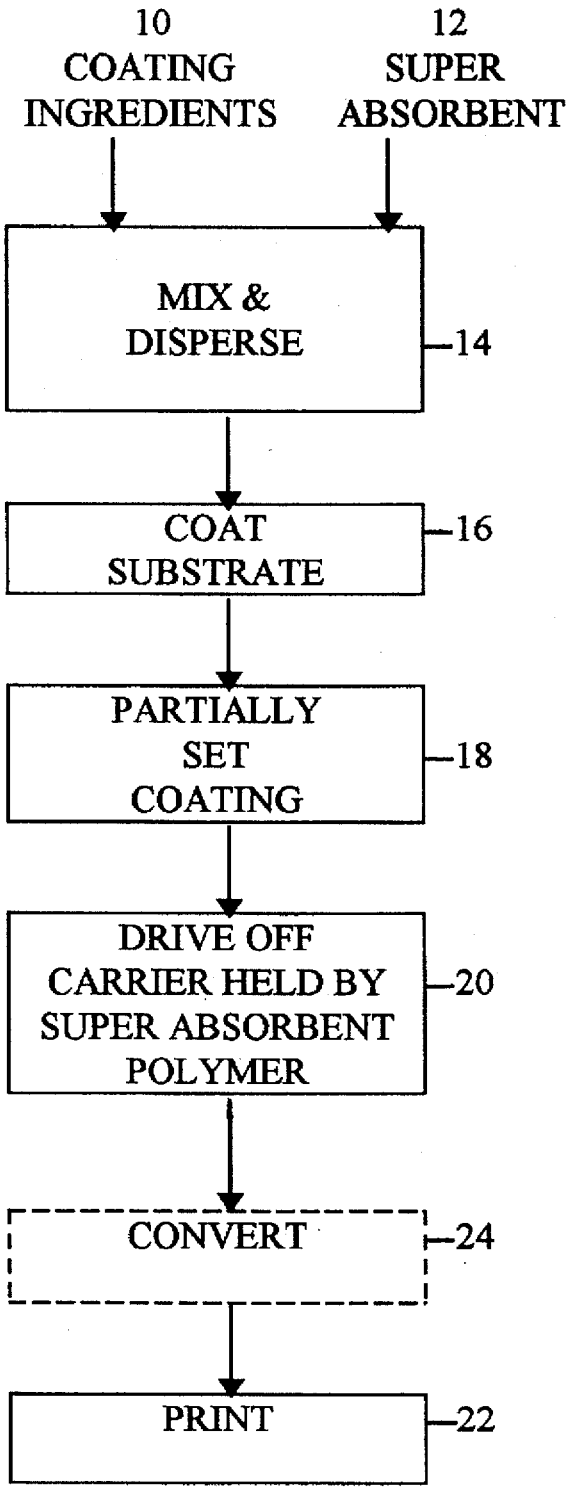
FIG. 1 is a schematic illustration of the process of the present invention.

As shown in FIG. 1, the conventional, preferably water-based coating, is formed by supplying as indicated at 10 the conventional ingredients (including a carrier) of the coating composition and adding a super absorbent as indicated at 12 to these ingredients in a mixer 14 wherein the coating ingredients, including the carrier, and the super absorbent are mixed and the super absorbent dispersed and its particle size defined.

After the coating ingredients have been mixed and the super absorbent well dispersed throughout the coating, while retaining the particle size of super absorbent elements to produce swelled super absorbent particles the majority of which have a minimum dimension of less least 5 microns. If the particle size of the super absorbent in the coating is less than about 5 microns the resultant finished surface produce by drying of the coating will not be effective to achieve the required properties for printing of the board using conventional printing techniques as applied to uncoated multiply boards.

The particle size of the superabsorbant material use must be such that the discrete void spaces left in the coating after the coating is set be in the range of at least 5 microns and preferably less than 100 microns.

Generally any suitable super absorbent material that swells significantly by absorption of the carrier and the shrinks substantially when the carrier is driven off is useable so that it tends to form a layer in the cavity formed, however super absorbent polyacrylates have been found particularly suitable. In particular a super absorbent formed of 100% sodium polyacrylate in the form of a dry white powder or latex emulsion have been found to possess the required particle size and degree of swelling when saturated with water as the carrier in the coating composition.

Figure 2:
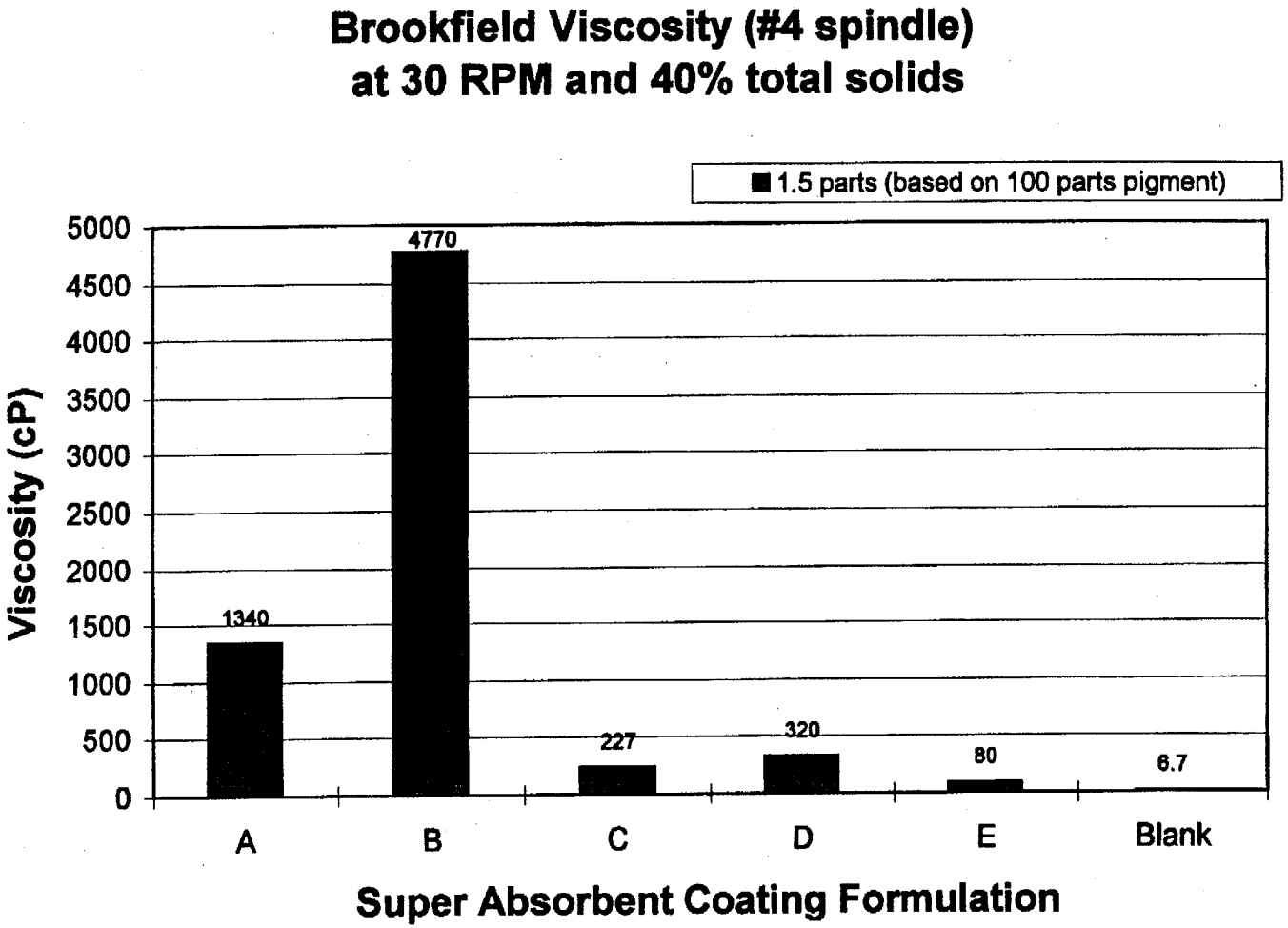
FIG. 2 is a graph comparing the Brookfield Viscosity (cP) of a number of different coating formulations showing the difference in viscosity between those coating that were found to be effective for the present invention and those that were not.

The viscosity of the coatings that were tried and were effective were noted to be significantly different from those that were not effective, as shown in FIG. 2 wherein the viscosities of same basic coating formulations but containing different absorbents are shown. Super absorbents A (a dry powder type) and B (a latex type) were the only ones found to perform satisfactory. The latex type had more uniform size and a greater number of smaller particles than the dry powder type. These measurements indicate that the superabsorbant containing coating should have a Brookfield Viscosity of at least about 500 cp when measured with a #4 spindle operated at 30 rpm. In the tests reported in FIG. 2 the carrier in the coating was water, the coating contained 40% solids, and there were 1.5 parts of super absorbent (based on 100 parts of pigment). The blank sample is the base formulation without any super absorbant added.

It is important that the swelled particle size or void size produced in the coating have a minimum dimension of at least 5 microns and preferably 10 to 60 microns. Preferably this minimum dimension will not exceed 100 microns. If the swelled particle size is too large the rheology of the coating formulation will be adversely affected and coating uniformity will be affected. The swelled particles are generally spherical and thus the minimum and a maximum dimension of the swelled particles will be about the same.

Generally the super absorbent will be present in the coating formulation in the amount of between about 0.5 and 10% w/w based on the dry solids in the coating. More preferably the super absorbent will be present in the range of between 0.5 and 3%.

In any event, once the coating has been properly mixed and the super absorbent dispersed therein as indicated at 14, the coating is applied to coat a substrate as indicated at 16.

The amount of coating applied to the substrate will be any reasonable amount of coating as is normally used in coating board, but preferably the coating will be applied in the amount of 10 to 100 $gm/m^2$, preferably about 15 to 25 $gm/m^2$.

After the carrier held by the super absorbent polymer has been driven off, the material or the coated board or substrate may then be printed as indicated at 22.

The type of coating apparatus used may be any suitable system such as an air knife coater or a rod type coater.

The coating is then partially set as indicated at 18 and the carrier absorbed in the super absorbent material is then driven off as indicated at 20 after the coating has sufficiently set so that the void area formed by the driving off of the carrier obtained by the super absorbent material results in the formation of voids within the coating.

It will be apparent that the super absorbent material tends to hold or retain the carrier and thus the carrier associated with the elements of the coating tends to be driven off or freed from these other elements before it is released by the super absorbent material, the net effect being that sufficient gelling or setting of the coating occurs before significant amount of the carrier (water) absorbed by the super absorbent material is released. The delayed release of this bound carrier forms voids within the coating and produces a significantly rougher surface on the coating and generally a more porous coated board as compared to that normally obtained when conventional coatings are applied. The coated surface may then be printed as indicated at 22 or converted as indicated at 24 and then printed as indicated at 22.

Figure 5:
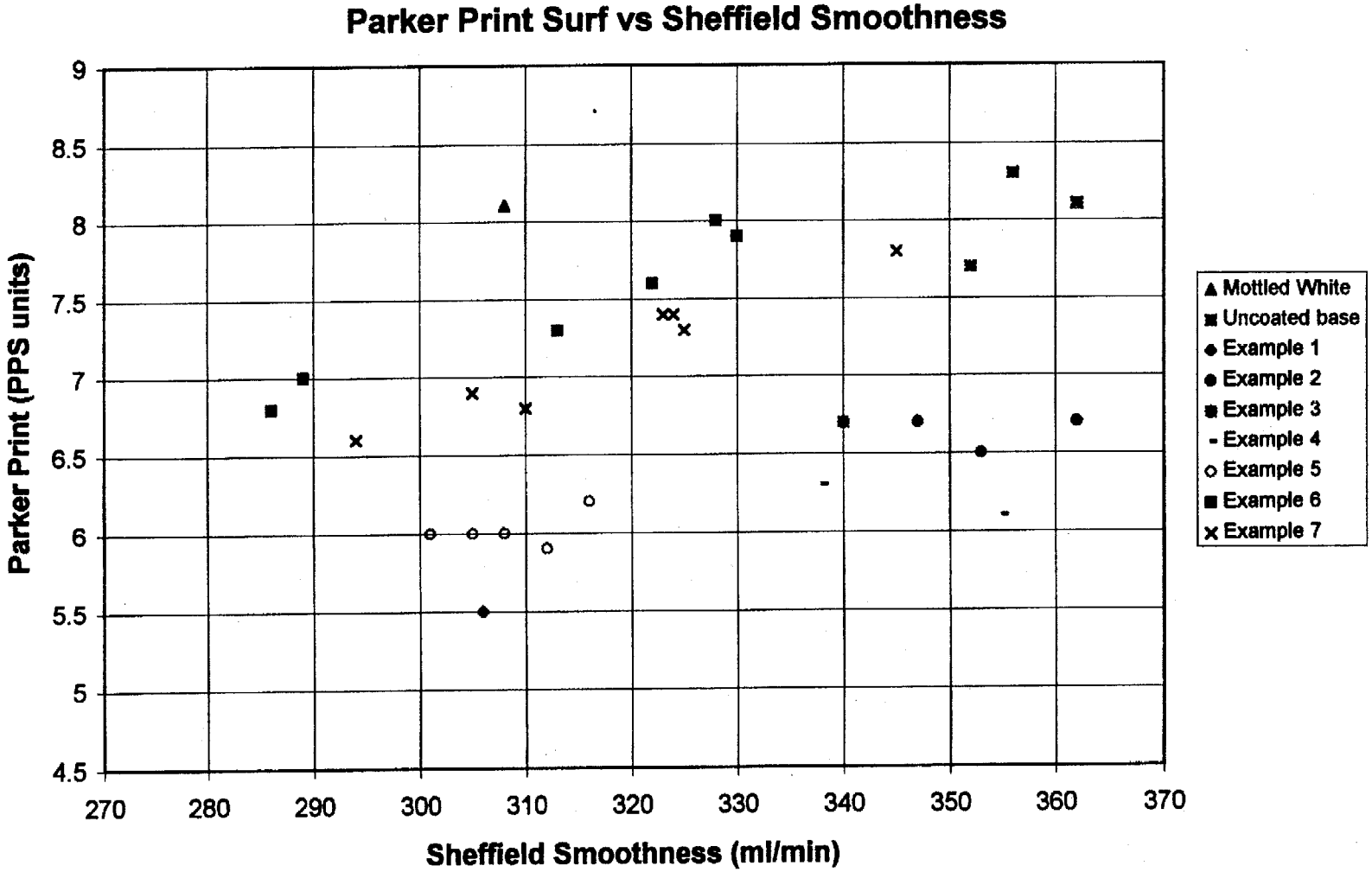
FIG. 5 is a plot of Parker Print Surf measured roughness of the surface of various samples of coated board in PPS units versus the corresponding Sheffield Smoothness measurement in ml/min.

Generally, the surface of the coating, when used to simulate a multiply matte white board, i.e. a linerboard having a layer of bleached pulp on its surface will have a ratio of Sheffield Smoothness (SS) to a Parker Print Surf (PPS), smoothness as illustrated in FIG. 5 such that at a SS of at 290 ml/min the surface will have a PPS of at least 6.5 PPS units and at a SS of 330 ml/min a PPS of at least 7 (see FIG. 5).

Figure 3:
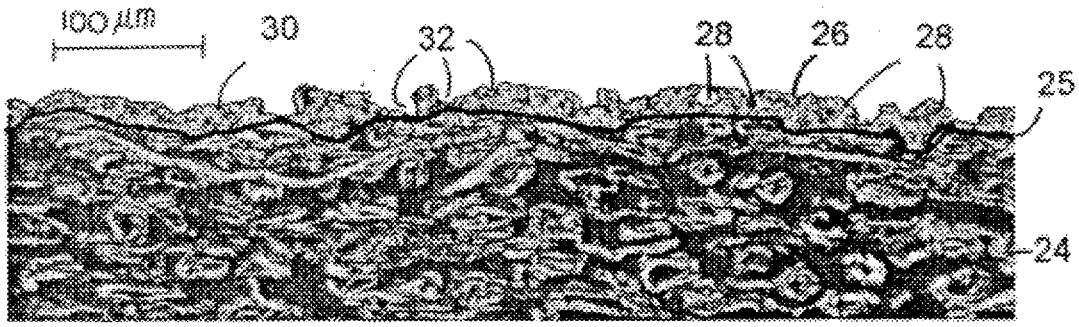
FIG. 3 is a specific example of an enlargement of a cross-section through a coated board coated with a coating incorporating the present invention.

The resultant product as indicated in photomicrograph of FIG. 3 comprises a substrate 24 and a coating 26. The line 25 has been added to the photomicrograph of FIG. 3 to show the line of demarcation between the coating 26 and the substrate 24. The coating is formed with a plurality of voids schematically indicated at 28, many of which are adjacent to and exposed on the surface 30 thereby to form cavities 32 opening to the exposed surface 30. These voids 28 (and cavities 30) define the roughness of the surface 30 and are a major factor in determining the porosity of the coating 26.

Figure 4:
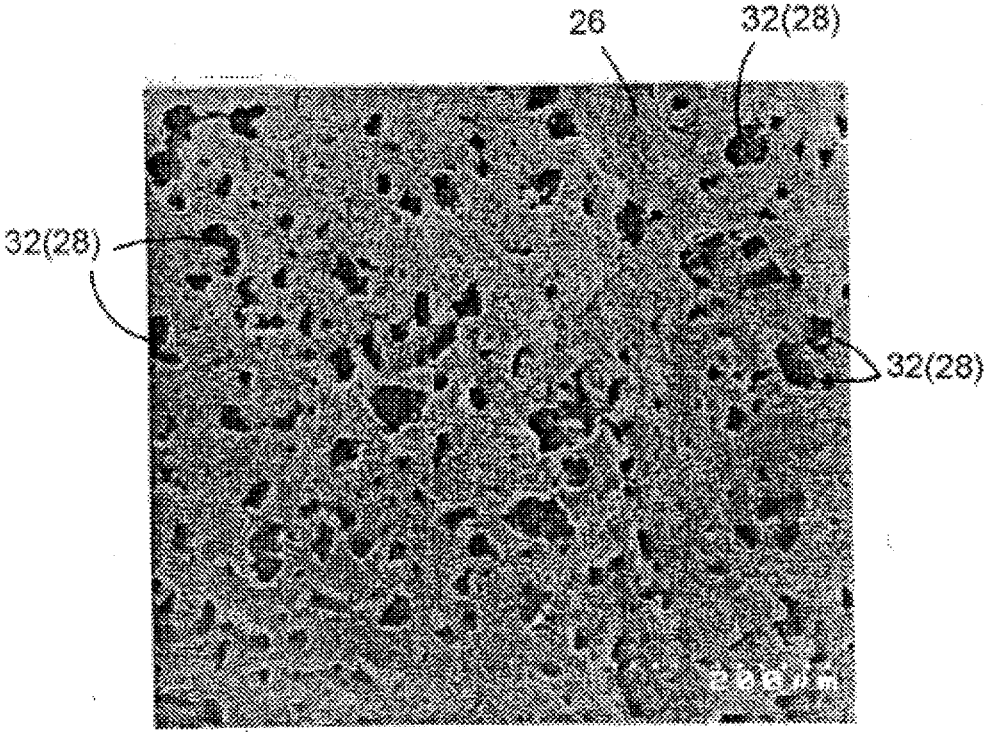
FIG. 4 is a plan view of a board coated in accordance with the present invention.

FIG. 4 is a photomicrograph showing a plan view of a portion of the surface 30 with cavities 32 showing as black spots on the surface.

The porosity of the coated board is believed to be a significant property facilitating effective priming of the coated board. Generally, the Gurley Porosity of the coated board should be less than about 3,500 sec/100 ml preferably less than 3,000 se./100 ml and most preferably less than 2,500 sec/100 ml.

The Print Length, as will be shown by the Examples hereinbelow, will preferably be less than 12 cm and more preferably less than 10.5 cm measured on an MB Print Indicator.

In printing the rate of absorption of the ink carrier into the substrate, i.e. perpendicular to the surface of the substrate, is important to the printing operation and to the quality of the printing as is the amount of lateral diffusion of the ink carrier along the surface of the substrate, i.e. parallel to the surface of the substrate. Generally the former should be rapid and the later should be minimized for the best quality of printing. It is believed that the presence of the redried super absorbent in the pockets or voids in the coating increases the rate of ink carrier absorption directly into the substrate in a direction substantially perpendicular to the surface of the substrate thereby to increase absorption of carrier in a direction perpendicular to the surface which decreases the tendency for lateral diffusion of the carried along the surface. This increase in the rate of absorption perpendicular to the surface of the substrate also may reduce the amount of conventional drying required to dry the coating.

Examples

In the following examples 1 to 7 a paper substrate (42# unbleached linerboard) was coated on one side only (top side) at a speed of 1000 fpm. The paper so coated was dried using a combination of infra red (IR) and heated air dryers. The dried coated papers produced has coat weights ranging from 6 to 45 g/m$^2$.

Samples of the dried coated papers were conditioned in accordance with TAPPI Standard T-402 for a minimum of 12 hours. Surface properties of the samples were evaluated in accordance with TAPPI Standards (when applicable). Tests included brightness (T-452), Sheffield smoothness (T-538), and Parker Prim Surface (hard backing, 20 psi air pressure).

Example 1 (Prior Art)

A series of bent blade coating trials was performed using an aqueous coating composition prepared by blending the following ingredients by weight:

Formulation A

1. $CaCO_3$—70 parts
2. No.1 Clay—30 parts
3. SB Latex—12 parts
4. Starch—6 parts starch
5. Calcium Stearate—0.8 parts
6. Cross Linker—0.4 parts
7. CMC—0.08 parts
8. Dispersant—0.2 parts.
9. Water to a total solids of 64%

No void structure was observed when samples were examined under a microscope.

Example 2 (Prior Art)

Identical to Example 1 except for the following changes: Aqueous coating mixtures Formula A was modified as follows:

Formulation B (same as Formulation A except for the following changes)

1. $CaCO_3$—70 parts
2. SB Latex—13 parts
3. PVAC—5 parts
4. No starch addition
5. CMC –0.3 parts Water added to total solids of 66%

A grooved rod metering device was used instead of a bent blade.

No void structure was observed when samples were examined under a microscope.

Example 3 (Prior Art)

A grooved rod coating trial on commercial equipment using a commercial aqueous coating formulation supplied by Michaelman.

No void structure was observed when samples were examined under a microscope.

The coated linerboard so produced was converted into a double face board, the coated linerboard being incorporated at the double backer as the outside linerboard. Sheets were then primed and converted to boxes on a flexo-folder-gluer at the same time as sheets incorporating a mottled white linerboard in the outside linerboard position were being converted and printed.

The samples incorporating the coated linerboard had poor print quality to due tracking and smearing of ink (poor ink strike-in) and to a high percentage (>50%) of bar code scan failures.

Example 4 (Prior Art)

Rod coating trials were performed on commercial equipment using a coating formulation as recommended by the owner of the commercial equipment. The same coating formulation was applied using two different grooved rods.

No void structure was observed when samples were examined under a microscope.

The coated linerboard was converted into a double face board, the coated linerboard being incorporated at the double backer as the outside linerboard. Sheets were then primed and converted to boxes on a three color press followed by a flat bed die cutter. A mottled white linerboard was converted and printed in an identical manner. Samples incorporating the coated linerboard had poor print quality due to a high percentage (>50%) of bar code scan failures and to unacceptable print mottle in the solid print area. Print mottle was measured as the standard deviation in print density for the solid primed areas, see Table I.

Example 5 (Prior Art)

Commercial coating trials at a custom coating facility using a bent blade (precoat) followed by an air knife and a commercial coating formulation. No void structure was observed when samples were examined under a microscope.

The coated linerboard was converted into a double face board, the coated linerboard being incorporated at the double backer as the outside linerboard. Sheets were then printed and converted to boxes on a flexo-folder-gluer. The samples incorporating the coated linerboard had poor print quality to due tracking and smearing of ink (poor ink strike-in) and to poor trapping of the yellow color by the black color.

Example 6 (Present Invention)

The same equipment and process conditions as Example 4 except for the use of a dry powder sodium polyacrylate super absorbent polymer as the superabsorbant.

Coating formulation was prepared by blending the following ingredients by weight:

1. $CaCO_3$—50 parts
2. No. 3 Reg. Delam Clay—25 parts
3. Calcined Clay—25 parts
4. PVA Latex—18 parts
5. Sodium polyacrylate (dry powder)—1.5 parts 6. Water to a total solids of 50%

The coated linerboard was converted and printed as in Sample 5. Acceptable print quality was obtained. There was limited tracking and smearing of the ink. The yellow ink was trapped by the black. The printed images were also much more clearly defined in comparison to Example 5.

Example 7 (Present Invention)

Commercial air knife coating using the same equipment as in Example 5 except for no bent blade precoat. Identical coating formulation as in Example 6.

A similar PPS to Sheffield relationship to Example 6 was obtained (see FIG. 5). A void structure in the coating was observed when the samples were examined under the microscope.

Coated linerboard was converted and printed similarly to Example 4. Print quality equivalent to a mottled white linerboard was obtained. Print mottle was comparable.

TABLE I

| Example | Liner Tested | Print Mottle (%) |
|---|---|---|
| 4 | Mottled White | 1.4 |
| 4 | Coated Board | 4.2 |
| 7 | Mottled White | 1.6 |
| 7 | Coated Board | 1.6 |

Discussion of Examples 1 to 7

As demonstrated in FIG. 5, the Parker Print versus Sheffield Smoothness measurements for formulation 6 and 7 is similar to uncoated linerboard and is significantly different from Example 1 through Example 5. A void structure in these coatings was observed when the samples were examined under the microscope.

Figure 6:
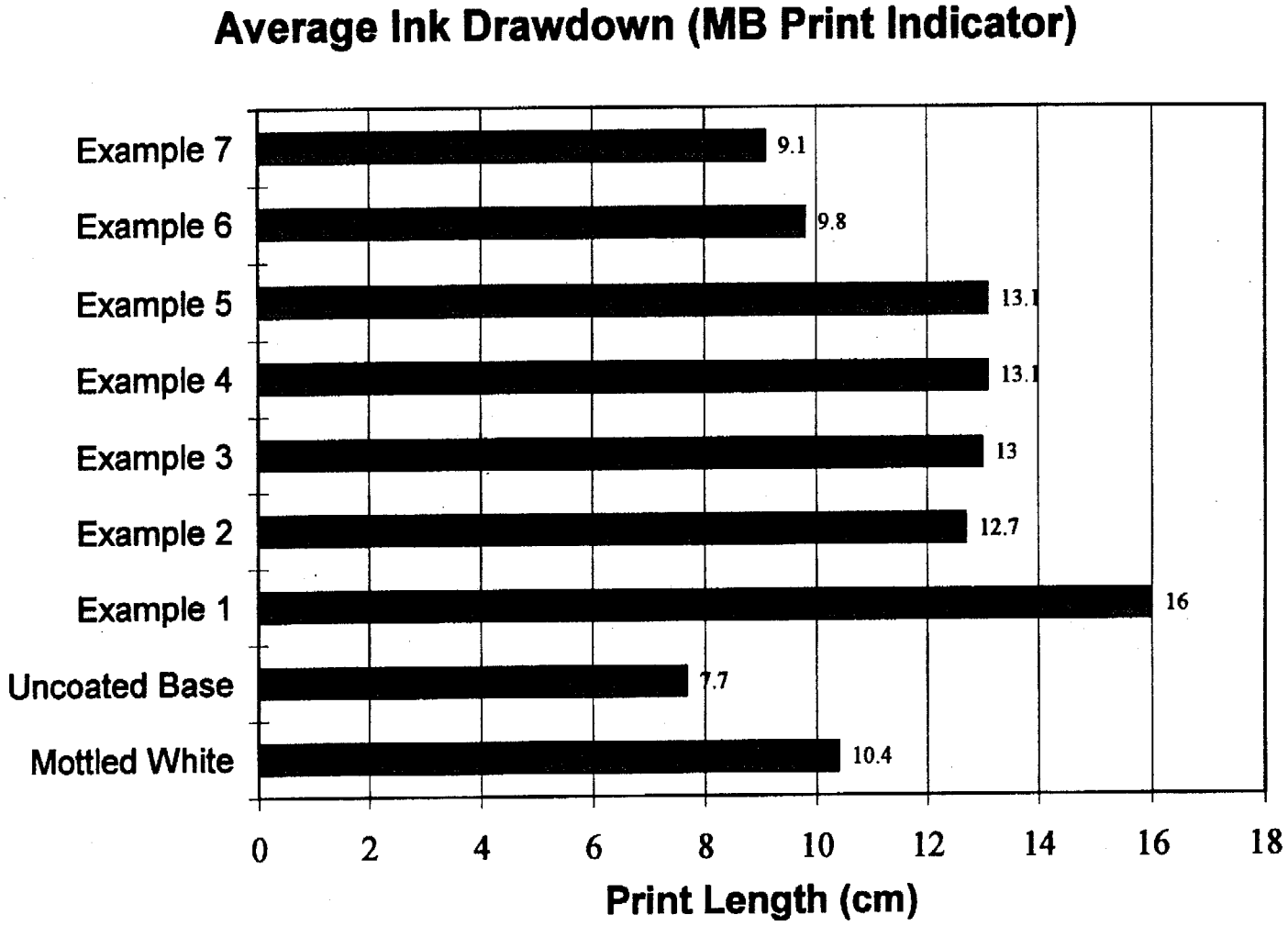
FIG. 6 is a graph of Print Length (era) measured on the MB Print Indicator demonstrating the different in Print Length of various samples of coated board.

FIG. 6 shows the Ink Drawdown measurements made on an MB Print Indicator for the products produced in Examples 1 to 7 and for comparison similar test on the uncoated base stock and a typical mottled white board. It is apparent that the two examples that were successful had Print lengths of less than 9 cm; the product they are intended to replace had a Print Length of 10.4 and those that were unsuccessful had Print lengths significantly longer than 12 cm indicating that Print Lengths less than about 12 may still produce the required result and that Print Lengths less than about 10.5 are preferred.

Example 8

Test were conducted on two different boards, the first having a basis weight of 38 gm/m$^2$ and the second a basis weight of 69 gm/m$^2$. The first and second boards had porosities before coating respectively of less than 66 sec/100 ml and less than 28 sec/100 ml and porosities after coating using a coating formulated in accordance with the present invention respectively of less than 2000 sec/100 ml and 1000 sec/100 ml. When the first board was coated with conventional coatings its porosity was greater than 4800 sec/100 ml.

It has been found that for a brighter product or to reduce the coat weight applied, titanium may be substituted for some of the delaminated clay. Having described the invention, modifications will be evident to those skilled in the art without departing from the scope of the invention as defined in the appended claims.

We claim:

1. A coated fibrous substrate comprising a fibrous substrate, a coating on at least one surface of said fibrous substrate, said coating being porous and having voids formed therein, said coating forming an exposed coating surface on a side of said coating remote from said one surface, a number of said voids open through said exposed coating surface to enhance printability of said exposed coating surface, a majority of said voids having a size of at least 5 microns and less than 100 microns.

2. A coated substrate as defined in claim 1 wherein, said exposed coating surface has a surface roughness measured by a Parker Print PPS of at least 6.5 PPS units for a corresponding Sheffield Smoothness of 290 ml/min and at least 7 PPS units for a corresponding Sheffield Smoothness of 330 ml/min.

3. A coated substrate as defined in claim 1 wherein, said coated fibrous substrate has a Gurley Porosity of less than 3,000 sec/100 ml.

4. A coated substrate as defined in claim 1 wherein, said exposed coating surface has a Print Length of less than 10.5 cm measured on an MB Prim Indicator.

5. A coated substrate as defined in claim 2 wherein, said coated fibrous substrate has a Gurley Porosity of less than 3,000 sec/100 ml.

6. A coated substrate as defined in claim 2 wherein, said exposed coating surface has a Print Length of less than 10.5 cm measured on an MB Print Indicator.

7. A coated substrate as defined in claim 3 wherein, said exposed coating surface has a Print Length of less than 10.5 cm measured on an MB Print Indicator.

8. A coated substrate as defined in claim 5 wherein, said exposed coating surface has a Print Length of less than 10.5 cm measured on an MB Print Indicator.

9. A coated substrate as defined in claim 1 wherein said fibrous substrate is a linerboard and said exposed coating surface simulates printability and aesthetics of a multiply mottle white board normally made by application of a suitable fiber layer to a core layer of fibers having different aesthetic value.

10. A coated substrate as defined in claim 2 wherein said fibrous substrate is a linerboard and said exposed coating surface simulates printability and aesthetics of a multiply mottle white board normally made by application of a suitable fiber layer to a core layer of fibers having different aesthetic value.

11. A coated substrate as defined in claim 3 wherein said fibrous substrate is a linerboard and said exposed coating surface simulates printability and aesthetics of a multiply mottle whim board normally made by application of a suitable fiber layer to a core layer of fibers having different aesthetic value.

12. A coated substrate as defined in claim 4 wherein said fibrous substrate is a linerboard and said exposed coating surface simulates printability and aesthetics of a multiply mottle white board normally made by application of a suitable fiber layer to a core layer of fibers having different aesthetic value.

13. A coated substrate as defined in claim 5 wherein said fibrous substrate is a linerboard and said exposed coating surface simulates printability and aesthetics of a multiply mottle white board normally made by application of a suitable fiber layer to a core layer of fibers having different aesthetic value.

14. A coated substrate as defined in claim 6 wherein said fibrous substrate is a linerboard and said exposed coating surface simulates printability and aesthetics of a multiply mottle white board normally made by application of a suitable fiber layer to a core layer of fibers having different aesthetic value.

15. A coated substrate as defined in claim 7 wherein said fibrous substrate is a linerboard and said exposed coating surface simulates printability and aesthetics of a multiply mottle white board normally made by application of a suitable fiber layer to a core layer of fibers having different aesthetic value.

16. A coated substrate as defined in claim 8 wherein said fibrous substrate is a linerboard and said exposed coating surface simulates printability and aesthetics of a multiply mottle white board normally made by application of a suitable fiber layer to a core layer of fibers having different aesthetic value.

* * * * *